United States Patent [19]

Igel et al.

[11] 4,299,083

[45] Nov. 10, 1981

[54] WRAP-WINDING SPINNING MACHINE

[75] Inventors: Wolfgang Igel, Ebersbach; Franz Freibichler, Albershausen; Werner Fehr, Uhingen-Diegelsberg; Willi Pfeifer, Eislingen, all of Fed. Rep. of Germany

[73] Assignee: Firma Zinser Textilmaschinen GmbH, Ebersbach, Fed. Rep. of Germany

[21] Appl. No.: 137,210

[22] Filed: Apr. 4, 1980

[30] Foreign Application Priority Data

Apr. 5, 1979 [DE] Fed. Rep. of Germany ..... 2913762

[51] Int. Cl.[3] ..... D02G 3/36; D01H 7/18; D01H 11/00

[52] U.S. Cl. ..... 57/18; 57/352; 57/354

[58] Field of Search ..... 57/16–18, 57/352, 354, 6, 12

[56] References Cited

U.S. PATENT DOCUMENTS 4,112,667 9/1978 Hatcher et al. ..... 57/352 X
4,129,979 12/1978 Hamel ..... 57/352 X
4,164,837 8/1979 Maag et al. ..... 57/18 X
4,170,101 10/1979 Bock ..... 57/18 X
4,226,077 10/1980 Hilbert ..... 57/18

*Primary Examiner*—John Petrakes
*Attorney, Agent, or Firm*—Edwin E. Greigg

[57] ABSTRACT

A wrap-winding spinning machine for producing wrapped yarns having draw frames for attenuating slivers, wherein one wrap-winding apparatus is associated with each draw frame is proposed, with the wrap winding apparatus further including a high speed rotor and a yarn channel coaxial with the axis thereof, the rotor associated with a driven hollow spindle and a bobbin supported thereon and a balloon limiter supported on the machine frame by upstanding opposed ribs. The bobbin supports a centrally apertured cap device with the cap device having a continuously curved, convex end face with a sharply curved rim that merges with the end disc of the bobbin. The aperture in the cap device is arranged to receive the feed of the winding thread and the sliver as it passes downwardly into the yarn channel and is emitted as a finished wrapped thread.

12 Claims, 1 Drawing Figure

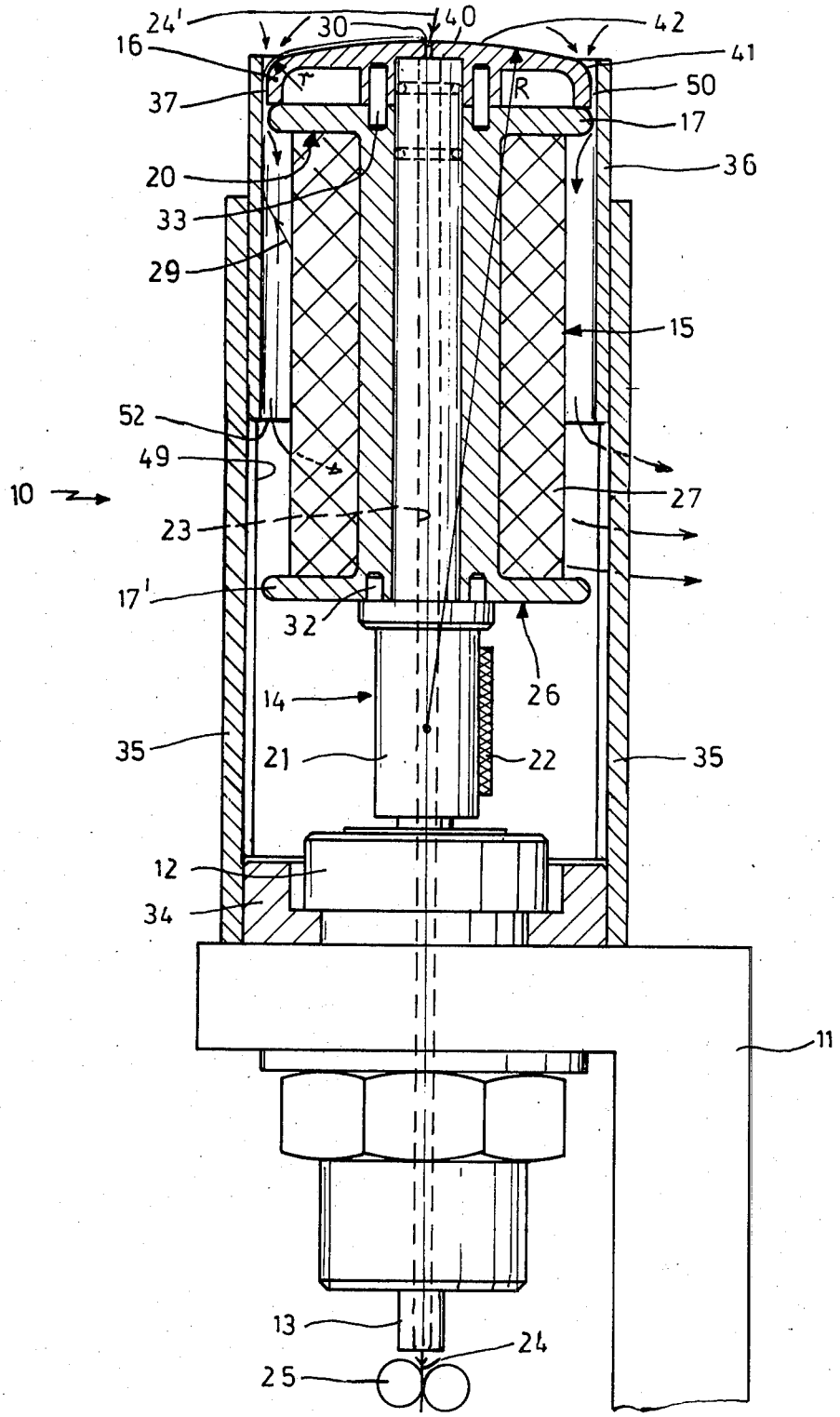
24'
30
40
42
16
41
37
50
17
36
20
33
29
15
52
49
10
27
23
17'
32
26
14
35
21
22
35
12
34
11
13
24
25

WRAP-WINDING SPINNING MACHINE

BACKGROUND OF THE INVENTION

The invention relates to a wrap-winding spinning machine for producing wrapped yarns, which has draw frames for attenuating slivers; in such a machine, one wrap-winding apparatus is associated with each draw frame for the purpose of wrap-winding the sliver delivered by this draw frame with at least one thin winding thread, preferably a filament, and the wrap-winding apparatus is followed by a reeling apparatus for reeling the wrapped yarn. This wrap-winding apparatus has a rotor, which is driven at very high rpm and has a yarn channel coaxial with its rotary axis; the rotor has a rotatably supported, driven hollow spindle and a bobbin interchangeably placed on the hollow spindle. The bobbin, in turn, carries the winding thread in the form of a thread winding body and is surrounded in spaced-apart fashion by a yarn-ballooning limiter having a closed circumferential wall. Finally, the yarn-ballooning limiter circumferentially surrounds the rotor head located at the top of the thread winding body located on the bobbin, forming a narrow annular gap.

The "draw frame" of the wrap-winding spinning machine is understood to be that area of one draw frame row of the machine which attenuates the sliver, the sliver serving in turn to produce a single wrapped yarn.

The slivers to be attenuated and wrapped are made up of fibers of finite length; that is, they are not endless filaments. These fibers may be, for example, cotton, wool, chemical, or cellulose fibers or any other vegetable, animal or synthetic fibers capable of being processed into wrapped yarn.

In a known wrap-winding spinning machine of this kind (disclosed in German laid-open application No. 24 28 483), the yarn-ballooning limiter is embodied as a cup closed on the bottom and fixedly disposed on the hollow spindle. The winding thread arriving from the bobbin runs from the inner wall of the yarn-ballooning limiter at a distance above the rotor head toward the yarn channel entrance of the twisting apparatus. It is unavoidable in such an arrangement that the rotating region having the winding thread, which is located between the yarn-ballooning limiter and the yarn channel, will capture fibers out of the air, fibers which may have their source in the sliver to be wrapped and also, in some cases, in the blowing-off fuzz which is inevitably present in the air in the area of the machine located in the spinning factories. The fibers caught up by the winding thread gather up into fiber tufts, specifically at that point where the winding thread leaves the yarn-ballooning limiter and in some cases also at the point where the winding thread runs over the outer edge of the end face of the bobbin, touching it. The winding thread runs through the fiber tuft and the tuft can grow larger and larger, as a result of which the thread tension of the winding thread is correspondingly greatly increased; the result can be severe fluctuations in the thread tension, which cause severe disruptions, because they cause disuniform wrap-winding of the sliver. It can also happen that the fiber tuft may be torn off after a time and carried along with the winding thread, which leads to plugging and attendant thread breaks, or an undesirable, slub-like thickening of the wrapped yarn may result.

OBJECTS AND SUMMARY OF THE INVENTION

It is accordingly a principal object of the invention to respond to the danger represented by the gathering up of fiber tufts on the rotating winding thread between the yarn-ballooning limiter and the yarn channel of the wrap-winding spinning apparatus.

In a wrap-winding spinning machine of the type described above, this object is attained in that the yarn-ballooning limiter has at least one air outlet opening located at a distance below the annular gap located between the yarn-ballooning limiter and the rotor head, with air flowing outward continuously through this opening during operation. Accordingly, air continuously flows into the yarn-ballooning limiter, through the annular gap, out of the space located above the rotor head and the yarn-ballooning limiter. Furthermore, the end face of the rotor head where the inlet of the yarn channel of the rotor is disposed is convexly curved in such a manner that, from the vicinity of the yarn-ballooning limiter up to the inlet of the yarn channel, it embodies at least substantially a thread guide face on which the winding thread slides.

As a result of this inventive arrangement, the gathering up of fibers into fiber tufts in the rotating region of the winding thread located between the yarn-ballooning limiter and the yarn channel of the wrap-winding apparatus is surprisingly prevented. As a result, the interruptions, yarn slubs, and thread breaks previously caused by the fiber tufts are eliminated, and this has an advantageous effect on the quality of the wrapped yarn. In addition, the inventive arrangement is structurally simple and can be inexpensively realized.

It has proved to be particularly advantageous for the winding thread to rest uninterruptedly on the end face of the rotor head from the point, located near the yarn-ballooning limiter, at which it first comes into contact with this end face as it arrives from the yarn-ballooning limiter up to the point where it enters the yarn channel. This can be realized particularly well and in a structurally simple manner by placing a cap device onto the bobbin on one end, the free end face of which cap device forms the end face of the rotor head and has the inlet of the yarn channel disposed in it.

In the sense of the invention, the term "rotor head" is understood to be that part of the rotor of the wrap-winding apparatus which is located above the thread winding body which is wound up on the bobbin. Thus, the upper end disc of the bobbin (if the bobbin has one) is also considered to be part of the rotor head. Preferably, as already noted, the end face of the rotor head can be the free end face of a cap device placed on the bobbin. This is also particularly favorable both structurally and in terms of cost. However, it is also conceivable for the end face of the rotor head to be differently embodied; for instance, it may be embodied in part by the upper end face of the hollow spindle and, for the rest, by the upper free end face of the bobbin, or only by the upper end face of the bobbin; the latter two possibilities, however, complicate the design of the bobbin and necessitate specialized structural forms for the bobbin.

Because it is particularly favorable for the winding thread to rest uninterruptedly on the end face of the rotor head from its arrival point on this end face until its entrance into the yarn channel, it is particularly favorable for this end face to be embodied by a one-piece structural part, so that any joints or ledges on the end face, which could cause fiber tufts to gather up on the winding thread, can be reliably precluded.

It is especially favorable for the winding thread to cover only a very short distance from the yarn-ballooning limiter up to its arrival on the end face of the rotor head. The annular gap between the rotor head and the yarn-ballooning limiter can have a radial width, at the narrowest point, of preferably 1.5 mm at maximum. In an experimental machine, which brought excellent results, this radial width was ca. 1 mm. It is also particularly advantageous for the end face of the rotor head to have a preferably smooth contour, which is circular-cylindrical, as it merges into an outer circumferential face of the rotor head.

The end face of the rotor head may efficiently be rotationally symmetrical relative to the rotary axis of the rotor. It is especially favorable for this end face of the rotor head to have a main region of slightly convex curvature in radial sectional planes, preferably having a radius of curvature of 100 to 140 mm, and a convexly curved rim region, directly adjacent on the outside thereof, of increased curvature in radial sectional planes, the latter rim region preferably having a radius of curvature of 5 to 8 mm, the value of approximately 6 mm being preferred.

In order for air to be aspirated continuously during operation into the annular gap between the rotor head in the yarn-ballooning limiter out of the space located above the rotor head and the yarn-ballooning limiter, it is necessary to take care that air flow out of the at least one air outlet opening of the yarn-ballooning limiter. This necessitates the presence of an air supply means. Preferably, the rotor and its bobbin, which are already present, can act as an air supply means, because as a result of the high rotor rpm, this rotor generates a strong "rotor wind." It can preferably be provided here that the bobbin protrude downward out of the yarn-ballooning limiter and that at least one air passage opening be located radially opposite this portion of the bobbin; through this air passage opening, an air flow generated by the bobbin can flow out, the air flow being made up at least in part of the air flowing out of the yarn-ballooning limiter, so that as a result air is continuously aspirated into the yarn-ballooning limiter through the upper annular gap.

In many cases, separate air supply means can also be provided, such as a blower or a ventilator, which serve to aspirate air into the yarn-ballooning limiter through the upper annular gap. The blower or ventilator can, if needed, be disposed centrally to all the wrap-winding apparatuses, or to numerous wrap-winding apparatuses, and can be connected with the yarn-ballooning limiters via one main line and various branch lines. A different advantageous possibility is the fixed, coaxial disposition of an air supply wheel on the rotor.

The yarn-ballooning limiter may advantageously be disposed in stationary fashion. In so doing, it is possible to attach it rigidly with the machine frame of the wrap-winding spinning machine. The rotary bearing, embodied as a roller bearing, of the hollow spindle of the rotor is efficiently kept elastic, so that the rotor, in obedience to the laws of centrifugal motion, can perform centrifugal movements of lesser amplitude, as is also conventional in textile spindles in ring spinning machines. If the yarn-ballooning limiter is rigidly attached to the machine frame, care must accordingly be taken that the annular gap between the rotor head and the yarn-ballooning limiter is sufficiently large, so that the rotor head cannot strike against the yarn-ballooning limiter. In general, a minimum radial width of ca. 1 mm is sufficient for this annular gap. The annular gap can be made smaller, if needed, by attaching the yarn-ballooning limiter rigidly to the rotor or to non-rotating, elastically supported bearing elements of the rotary bearing of the rotor.

The invention will be better understood and further objects and advantages thereof will become more apparent from the ensuing detailed description of a preferred exemplary embodiment taken in conjunction with the drawing.

BRIEF DESCRIPTION OF THE DRAWING

The single FIGURE of the drawing shows a particularly advantageous exemplary embodiment of a wrap-winding spinning apparatus of a wrap-winding spinning machine, not shown in further detail, in a side view partially shown in longitudinal section.

DESCRIPTION OF THE PREFERRED EMBODIMENT

This wrap-winding spinning apparatus 10 has a bearing sheath 12 secured to a stationary rail 11 of the machine frame. A bearing is held with restricted elasticity in the bearing sheath 12 and rotatably supports a foot shaft 13, which penetrates the sheath 12, of a hollow spindle 14 of a rotor 15 with a vertical rotary axis, so that the rotor 15 can perform small radial swings for the purpose of performing centrifugal movements so that its course will be smooth. These radial swings, at the rotor head 20 embodied by a cap device 16 and the upper end disc 17 of a bobbin 26 of the rotor 15, are even in unfavorable cases smaller than 1 mm to either side.

The hollow spindle 14 has a whorl 21, against which a tangential belt 22 serving as the rotary drive of this rotor rests, which simultaneously drives the rotors of all the rows of wrap-winding spinning apparatuses 10 disposed on the respective side of the machine, or on both sides of the machine. The rotor 15 is penetrated over its entire axial length by a yarn channel 23, coaxial with its longitudinal axis, through which the finished wrapped yarn passes. The wrapped yarn 24 which exits at the bottom of the hollow spindle 14 is delivered by means of a feed roller pair 25 to a thread reeling apparatus (not shown), where it is wound up onto a spool, preferably a cross bobbin.

The rotor 15 comprises the hollow spindle 14, the bobbin 26 interchangeably placed upon it, and the cap device 16 placed upon the upper end disc 17 of the bobbin 26. This cap device 16 and the bobbin 26 are disposed coaxially relative to the rotary axis of the hollow spindle 14 and are efficiently rotationally symmetrical. The bobbin 26 carries a thread winding body 27, namely the winding thread 29, with which the sliver 24', having been delivered to the upper central inlet 30 of the yarn channel 23 by the draw frame, not shown, is wrapped about in order to strengthen it, resulting in the finished wrapped thread 24.

The winding thread 29 may preferably be a single, endless filament, preferably of polyester or polyamide.

For the sake of connecting the bobbin 26 with the hollow spindle 14 in a rotationally fixed manner, pins 32 are disposed on an annular shoulder of the hollow spindle 14 acting as a platform for the lower bobbin end disc 17', the pins 32 protruding in a form-locking manner into axial blind bores of the bobbin 26. The rotationally symmetrical cap device 16 is likewise centered by the hollow spindle 14 relative thereto and is connected with the bobbin 26 in a rotationally fixed manner by pins 33 protruding downward beyond its bottom, the pins 33 protruding in a form-locking manner into axial blind bores in the upper end disc 17 of the bobbin 26. Both the cap device 16 and the bobbin 26 may be removed from the hollow spindle 14 manually.

Two narrow, vertical ribs 35 are fixedly disposed, diametrically opposite one another, on a ring 34 centered relative to the bearing sheath 12 and firmly connected to the rail 11. The upper ends of the ribs 35 are secured on the outside on a yarn-ballooning limiter 36, which is embodied as a circular-cylindrical sheath, and thus they support this yarn-ballooning limiter 36.

The yarn-ballooning limiter 36 has an interior diameter which is slightly larger than the outer diameter of the cylindrical outer circumferential face 37 of the cap device 16, the amount of the difference being only large enough that between the yarn-ballooning limiter 36 and the cap device 16 there is a narrow, cylindrical annular gap 50 sufficient to keep the cap device 16 from striking against the balloon limiter 36 despite the (small) swings which it performs. The diameter of this outer circumferential face 37 of the cap device 16 corresponds to the largest diameter of the upper end disc 17 of the bobbin 26, on which end disc 17 the cap device 16 is seated. In a form of embodiment which is not shown, the outer circumferential wall of the cap device is lengthened toward the bottom and it engagingly overlaps the bobbin end disc, which is correspondingly smaller in diameter, either in part or entirely; alternatively, if needed, it may protrude still further downward by a short distance in such a manner that the unwinding of the winding thread located on the bobbin is not interfered with.

The short outer circumferential face 37 of the cap device 16 is adjoined upwardly by a continuously convexly curved, smooth end face 40, which is rotationally symmetrical relative to the rotary axis of the rotor. Toward the top, the end face 40 is entirely free and in its center it contains the inlet 30 of the yarn channel 23, which has a substantially smaller diameter than the portion of the yarn channel 23 located in the hollow spindle 14. The minimum diameter of this inlet 30 may be, by way of example, 1 mm; however, depending on the thickness of the wrapped yarn to be produced, the diameter of this inlet can also be larger or smaller than that.

The continuously curved, convex end face 40 of the rotor head 20 comprises a rim area 41 which (in radial longitudinal section planes) is more sharply convexly curved and the main area 42 which merges continuously with this rim area 41 and (in radial logitudinal sectional planes) is substantially less sharply convexly curved. In an experimental machine which was actually built, the following dimensions pertained:

Radius R of main area 42 of end face 40: 120 mm
Radius r of rim area 41 of end face 40: 6 mm
Diameter of cylindrical outer circumferential face 37 of cap device 16: 60 mm
Inner diameter of yarn-ballooning limiter 36: 62 mm
Axial length of yarn-ballooning limiter 36: 65 mm The winding thread 29 arriving from the yarn-ballooning limiter 36, which entirely surrounded the rim area 41 of the end face 40 of the cap device 16, took the shortest path, without forming a thread balloon, to its point of contact, approximately at the center of the rim area 41 of the end face 40, this point thus being still quite close to the yarn-ballooning limiter 36. The winding thread 29 then remained uninterruptedly in contact with the very smooth end face 40 during its continuing travel to the inlet 30 of the yarn channel 23. Thus, the winding thread 29 glided without interruption on this area of the end face 40, which thus formed an uninterrupted thread guide face and extended from near its lower rim (corresponding to the upper rim of the cylindrical circumferential face 37 of the cap device 16) up to the inlet 30 of the yarn channel 23.

The axial length of the thread winding body 27 was 80 mm, and the lower end plane of the yarn-ballooning limiter 36 was in its illustrated position, that is, ca. 27 mm above the plane determined by the lower end side of the thread winding body 27.

This wrap-winding apparatus produced excellent results during operation. The wrapped yarns were of very good quality, and they were uniformly wrapped or wound about by the winding thread. No fiber tufts formed in the area of the winding thread 29 between the balloon limiter 36 and the inlet 30 of the yarn channel 23. The rotating bobbin 26 created a strong bobbin wind during operation, which flowed continuously below the balloon limiter approximately tangentially downward away from the bobbin, because two large, open windows 49 interrupted only by the two narrow ribs 35 were disposed opposite the region of the bobbin 26 protruding downward beyond the balloon limiter 36. Thus, this "bobbin wind" could blow unhindered toward the outside, and as a result there is strong suction in the interior of the yarn-ballooning limiter 36, so that beginning above the yarn-ballooning limiter 36 and the rotor head 20, air flows intensively down into the yarn-ballooning limiter, that is, through the entire annular gap 50 between the yarn-ballooning limiter 36 and the rotor head 20 and flows out again. The yarn-ballooning limiter 36 is thus exposed to an intensive flow of air from top to bottom.

The convex end face 40 of the rotor head 20 also produces an aerodynamically favorable embodiment, so that in experiments with smoke filaments the filaments flowed from the top toward the annular gap 50 without turbulence.

This air flows through the yarn-ballooning limiter 36 from top to bottom and then out of the opening (air outlet opening) 52 in its end face and finally through the open windows 49 and out.

During operation, the rotor 15, as noted, rotates at very high rpm. The feed roller pair of the draw frame which is not shown delivers the sliver 24' at a constant advancement speed to the thread wrap-winding apparatus 10, and it has been found that a false spin is imparted to the sliver 24' located between the feed roller pair of the draw frame and the thread wrap-winding apparatus 10. The false spin makes it possible to dispose the feed roller pair of the draw frame at a relatively large distance from the inlet 30 of the yarn channel 23, which may if needed be even greater than the length of the fibers of the sliver 24'. This sliver 24', upon its entrance into the yarn channel 23, is wound about or wrapped by the winding thread 29. The thread transport roller 25 which transports the wrapped yarn 24 to the reeling apparatus draws the winding thread 29 off the bobbin 26 at the same time, by way of the finished wrapped thread 24 which it is transporting.

The illustrated wrap-winding apparatus 10 is drawn to scale to correspond with the experimental design referred to above, which has proved excellent in tests. The tests were conducted using filaments of dtex 8–15 as the winding threads and with slivers made of cotton and other materials as well, producing wrapped yarns on the metric numerical scale of Nm 34–80. The rotary speeds of the rotor were in the range of 35,000 to 42,000 rpm.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A wrap-winding spinning machine including a wrap-winding apparatus for producing wrapped yarns including slivers and at least one thin winding thread, preferably a filament, said wrap-winding apparatus further including a rotor to be driven at very high rpm and a yarn channel coaxial with a rotary axis thereof, said rotor having a rotatably supported, driven hollow spindle and a bobbin having a rotor head, and at least a lower area interchangeably placed on the hollow spindle, said bobbin arranged to carry the winding thread in the form of a thread winding body and further being surrounded in a spaced-apart manner by a yarn-ballooning limiter having an area and a closed circumferential wall, said yarn-ballooning limiter arranged to circumferentially surround said rotor head having an end face located at the top of said thread winding body and arranged to form a narrow annular gap between the circumference thereof and said yarn-ballooning limiter characterized in that said yarn-ballooning limiter has at least one air outlet opening disposed at a distance below said annular gap between said yarn-ballooning limiter and said rotor head, through which air continuously exits, and further wherein air continuously flows from above said rotor head through the annular gap, that said end face of said rotor head is provided with an inlet for said yarn channel of said rotor and is curved in a convex manner such that from the vicinity of the yarn-ballooning limiter up to the inlet of said yarn channel it forms at least substantially a thread guide face on which the winding thread glides.

2. A machine as claimed in claim 1, characterized in that said end face of said rotor head is embodied as rotationally symmetrically curved in convex fashion such that the winding thread which arrives from the balloon limiter runs up, near an outer rim of said end face, onto a convexly curved area thereof and thence remains in uninterrupted contact with said end face up to the inlet of the yarn channel.

3. A machine as defined by claim 2, characterized in that said rotationally symmetrical end face of said rotor head has a main area slightly convexly curved area in radial sectional planes, which convexly curved area extends from the yarn channel inlet up to said rim area of said end face which is substantially more sharply convexly curved in radial sectional planes.

4. A machine as claimed in claim 1, characterized in that said end face of said rotor head is embodied by a one-piece structural element.

5. A machine as defined by claim 1, characterized in that said end face of said rotor head is embodied by a cap device positioned onto said bobbin.

6. A machine as defined by claim 1, characterized in that said annular gap which is provided between said rotor head and said yarn-ballooning limiter has a radial width at its narrowest point of about 1.5 mm at maximum.

7. A machine as defined by claim 1, characterized in that said yarn-ballooning limiter is a circular-cylindrical sheath, further including carrier ribs arranged to support said yarn-ballooning limiter.

8. A machine as defined by claim 1, characterized in that said bobbin of said rotor extends downwardly out of said yarn-ballooning limiter and at least one air passage opening is disposed radially beneath said lower area of said bobbin, through which an air current generated by the rotation of the rotor can be discharged, said air current comprising at least in part the air which flows from said interior of said yarn-ballooning limiter.

9. A machine as defined by claim 1, characterized in that said balloon limiter is stationary.

10. A machine as defined by claim 1, characterized in that said bobbin is disposed on said hollow spindle and rotates therewith.

11. A machine as defined by claim 1, characterized in that said convex end face of said rotor head merges preferably continuously into a cylindrical outer circumferential face of said rotor head.

12. A machine as defined by any one of the foregoing claims, characterized in that said yarn-ballooning limiter is disposed so that the winding thread therefrom takes the shortest course to the end face of said rotor head without forming a thread balloon.

* * * * *